US007286152B2

(12) United States Patent
Mindler et al.

(10) Patent No.: US 7,286,152 B2
(45) Date of Patent: Oct. 23, 2007

(54) SYSTEM AND METHOD FOR EFFICIENT DONOR MATERIAL USE

(75) Inventors: Robert F. Mindler, Churchville, NY (US); Gary W. Anderson, Spencerport, NY (US); Daniel W. Kuchta, Brockport, NY (US); John E. Wright, Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 222 days.

(21) Appl. No.: 11/060,177

(22) Filed: Feb. 17, 2005

(65) Prior Publication Data

US 2006/0181596 A1 Aug. 17, 2006

(51) Int. Cl.
*B41J 2/315* (2006.01)

(52) U.S. Cl. ..... 347/212

(58) Field of Classification Search ..... 347/212, 347/171–172, 217–218; 346/76.1, 118; 358/1.14, 358/1.15; 400/120.01, 120.02, 226, 232
See application file for complete search history.

(56) References Cited

U.S. PATENT DOCUMENTS 5,533,819 A * 7/1996 Watanabe et al. ..... 400/226
5,567,066 A 10/1996 Paranjpe et al.
5,691,961 A 11/1997 Paranjpe et al.
5,803,627 A 9/1998 Paranjpe et al.
5,821,975 A * 10/1998 Gunther et al. ..... 347/217
6,724,493 B1 * 4/2004 Maruta et al. ..... 358/1.14
2002/0030731 A1 * 3/2002 Yahagi et al. ..... 347/218
2002/0191066 A1 * 12/2002 Bouchard et al. ..... 347/172

FOREIGN PATENT DOCUMENTS

GB 2 282 567 A 4/1995

* cited by examiner

*Primary Examiner*—K. Feggins
(74) *Attorney, Agent, or Firm*—Roland R. Schindler, II

(57) ABSTRACT

A method for operating more than one thermal printer adapted to print images by transferring donor material from patches of donor material from a donor ribbon onto a receiver medium, each printer being operable to print images in a manner that exhausts a full donor patch or a fractional donor patch during printing. In accordance with the method, a print order is received and it is determined whether a fractional donor patch set is available for printing at each printer. Portions of the print order are directed to the printers in a pattern that minimizes the number of printers having donor ribbon with a fractional donor patch set available after the printing order has been executed.

10 Claims, 7 Drawing Sheets

SYSTEM AND METHOD FOR EFFICIENT DONOR MATERIAL USE

CROSS REFERENCE TO RELATED APPLICATIONS

Reference is made to commonly assigned, co-pending patent application U.S. Ser. No. 11/060,178, entitled SYSTEM AND METHOD FOR EFFICIENT DONOR MATERIAL USE, filed concurrently herewith in the name of Robert F. Mindler.

FIELD OF THE INVENTION

The present invention relates to printing systems for managing printing by multiple printers and methods for operating the same to improve the printing efficiency of each.

BACKGROUND OF THE INVENTION

In thermal printing, it is generally well known to render images by heating and pressing one or more donor materials such as a dye, colorant or other coating against a receiver medium. The donor materials are provided in sized donor patches on a movable web known as a donor ribbon. The donor patches are organized on the ribbon into donor sets, each set containing all of the donor patches that are to be used to record an image on the receiver medium. For full color images, multiple color dye patches can be used, such as yellow, magenta and cyan donor dye patches. Arrangements of other color patches can be used in like fashion within a donor set. Additionally, each donor set can include an overcoat or sealant layer It will be appreciated from this that in conventional thermal printers the size of the donor media patches defines the maximum size of full size image that can be printed using thermal printer. To provide flexibility of use, many thermal printers are capable of printing relatively large images such as 6"×8" images. While prints of this size are highly desirable for many uses, it can be challenging to use and store images printed at this size. Accordingly, consumers often request that such printers render images at a fraction of the full size image, such as images printed at the wallet size, 3"×5" size or 4"×6" size. Images at these sizes are more easily used and stored and require only a fraction of the donor material from a donor patch set.

Unfortunately, the printers of the prior art are not adapted to use the donor material from the fractional donor patch set for printing other images. Instead, it is conventionally known to have a thermal printer advance to the next complete donor set after printing a fractional size image so that the thermal printer is prepared to print any size image when the next printing order is received. It will be appreciated that this results in inefficient use of the donor material by causing increased printing costs. What is needed therefore is a method and system that enable more efficient use of donor material in a printing system.

SUMMARY OF THE INVENTION

In one aspect of the invention, a method for operating more than one thermal printer adapted to print images by transferring donor material from patches of donor material from a donor ribbon onto a receiver medium, each printer being operable to print images in a manner that exhausts a full donor patch or a fractional donor patch during printing.

In accordance with the method, a print order is received and it is determined whether a fractional donor patch set is available for printing at each printer. Portions of the print order are directed to the printers in a pattern that minimizes the number of printers having donor ribbon with a fractional donor patch set available after the printing order has been executed.

In another aspect of the invention, a printing system is provided. The printing system has more than one thermal printer with each thermal printer being adapted to print images by transferring donor material from patches of donor material on a donor ribbon to form an image on a receiver medium and with each printer being operable to print images in a manner that exhausts a full donor patch set or in a manner that exhausts a fractional donor patch set during printing. A controller is adapted to receive a print order that determines whether a fractional donor patch set is available for printing at each printer and to direct portions of the print order to the printers in a pattern that minimizes the number of printers having donor ribbon with a fractional donor patch set available after the printing order has been executed.

In still another aspect of the invention, a control system is provided for operating more than one thermal printer adapted to print images by transferring donor material from patches of donor material from a donor ribbon onto a receiver medium, each printer being operable to print images in a manner that exhausts a full donor patch or a fractional donor patch set during printing. The control system has a means for receiving a print order and a means for determining whether a fractional donor patch set is available for printing at each printer. A means is provided for directing portions of the print order to the printers in a pattern that minimizes the number of printers having donor ribbon with a fractional donor patch set after the printing order has been executed.

DETAILED DESCRIPTION OF THE INVENTION

Figure 1:
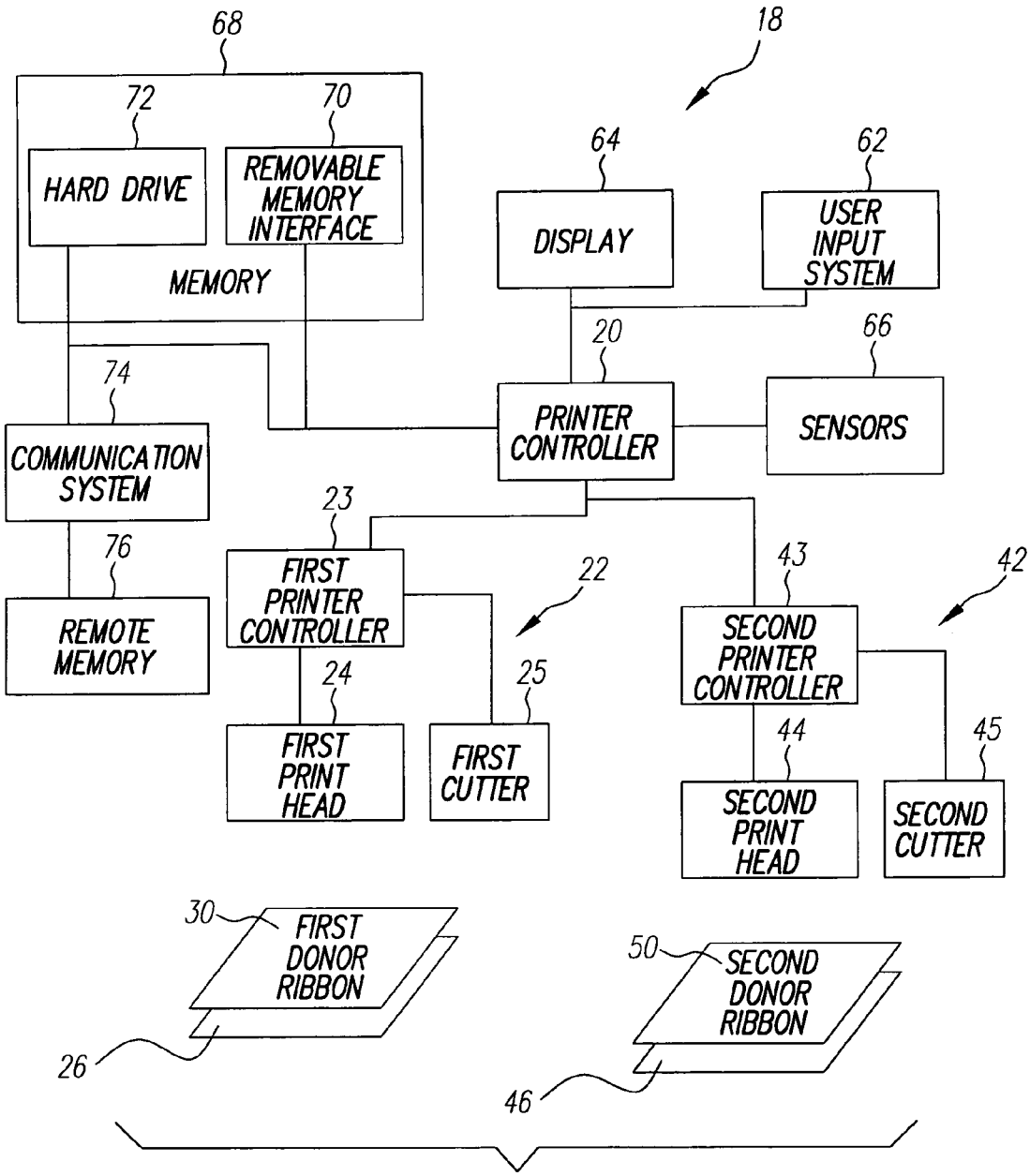
FIG. 1 shows a first embodiment of a printing system arrangement.
Figure 2:
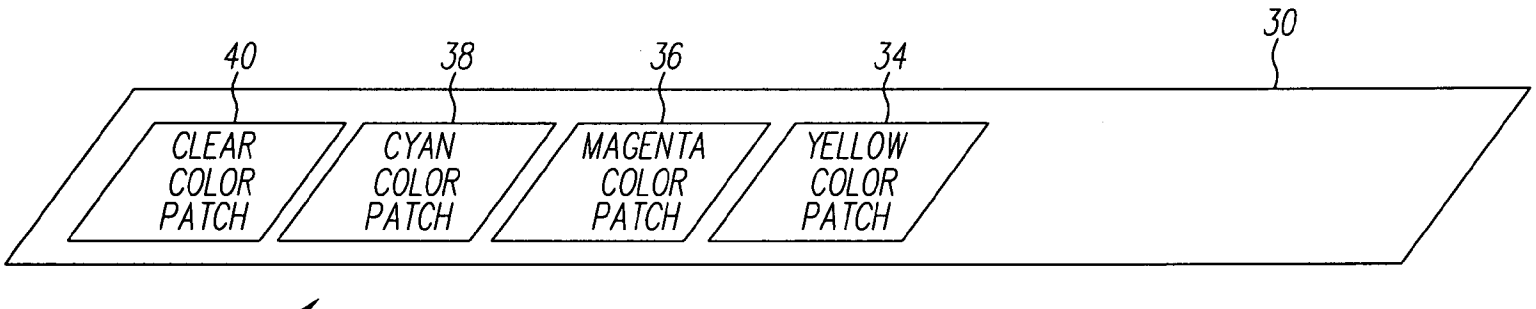
FIG. 2 shows one embodiment of a first donor ribbon.
Figure 3:
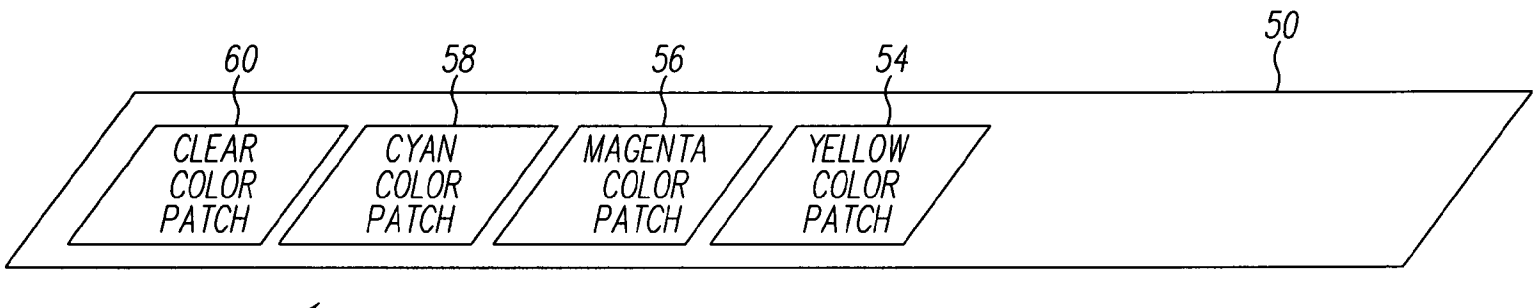
FIG. 3 shows one embodiment of a second donor ribbon.

FIG. 1 shows a first embodiment of a printing system of the invention. As is shown in FIG. 1, in this embodiment of the invention a printing system 18 is provided having a printing system controller 20, a first printer 22 and a second printer 42 to render images. First printer 22 comprises a first printer controller 23, a first thermal print head 24 and an optional first receiver medium cutter 25 for cutting first receiver medium 26 as desired to conform to the size of the images printed thereon. First printer controller 23 communicates with printing system controller 20 and in accordance with instructions therefrom, first printer controller 23 causes first thermal print head 24 to record images on a first receiver medium 26 by transferring material from a first donor ribbon 30 to first receiver medium 26. As is shown in FIG. 2, first donor ribbon 30 comprises a first donor patch set 32 having a yellow donor patch 34, a magenta donor patch 36, a cyan donor patch 38 and a clear overcoat patch 40. Similarly, second printer 42 comprises a second printer controller 43, a second thermal print head 44 and an optional second receiver medium cutter 45 for cutting second receiver medium 46 as desired to conform to the size of the images printed thereon. Second printer controller 43 communicates with printing system controller 20 and in accordance with instructions therefrom, second printer controller 43 causes second thermal print head 44 to record images on a second receiver medium 46 by transferring material from a second donor ribbon 50 to second receiver medium 46. As is shown in FIG. 3, second donor ribbon 50 comprises a second donor patch set 52 having a yellow donor patch 54, a magenta donor patch 56, a cyan donor patch 58 and a clear overcoat patch 60. Here too, other arrangements of colors and patch types can be used.

Printing system controller 20 can include but is not limited to a programmable digital computer, a programmable microprocessor, a programmable logic controller, a series of electronic circuits or a series of electronic circuits reduced to the form of an integrated circuit, or a series of discrete components. Printing system controller 20 is programmed or otherwise provided so that printing system controller 20 operates first printer 22 and second printer 42 based upon input signals from a user input system 62, an output system 64, sensors 66, a memory 68 and a communication system 74.

User input system 62 can comprise any form of transducer or other device capable of receiving an input from a user and converting this input into a form that can be used by printing system controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by printing system controller 20 to provide human perceptible signals for feedback, informational or other purposes.

Sensors 66 are optional and can include light sensors and other sensors known in the art that can be used to detect conditions in the environment surrounding printing system 18 and to convert this information into a form that can be used by printing system controller 20 in governing operation of first printer 22 and second printer 42. Sensors 66 can include audio sensors adapted to capture sounds.

Data including but not limited to control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 70 for communicating with removable memory (not shown) such as a magnetic, optical or magnetic disks. In the embodiment of FIG. 1, memory 68 is also shown having a hard drive 72 that is fixed with printing system 18 in a remote memory system 76 that is external to printing system controller 20 such as a personal computer, computer network or other imaging system.

In the embodiment shown in FIGS. 1 and 2, printing system controller 20 has a communication system 74 for communicating external devices such as remote memory system 76. Communication system 74 can be for example, an optical, radio frequency circuit or other transducer that converts electronic signals representing an image and other data into a form that can be conveyed to a separate device by way of an optical signal, radio frequency signal or other form of signal. Communication system 74 can also be used to receive a digital image and other information from a host computer or network (not shown). Printing system controller 20 can also receive information and instructions from signals received by communication system 74. In certain embodiments communication system 74 can be used to effect wired or wireless communication between printing system controller 20, first printer controller 23 and/or second printer controller 43.

Figure 4:
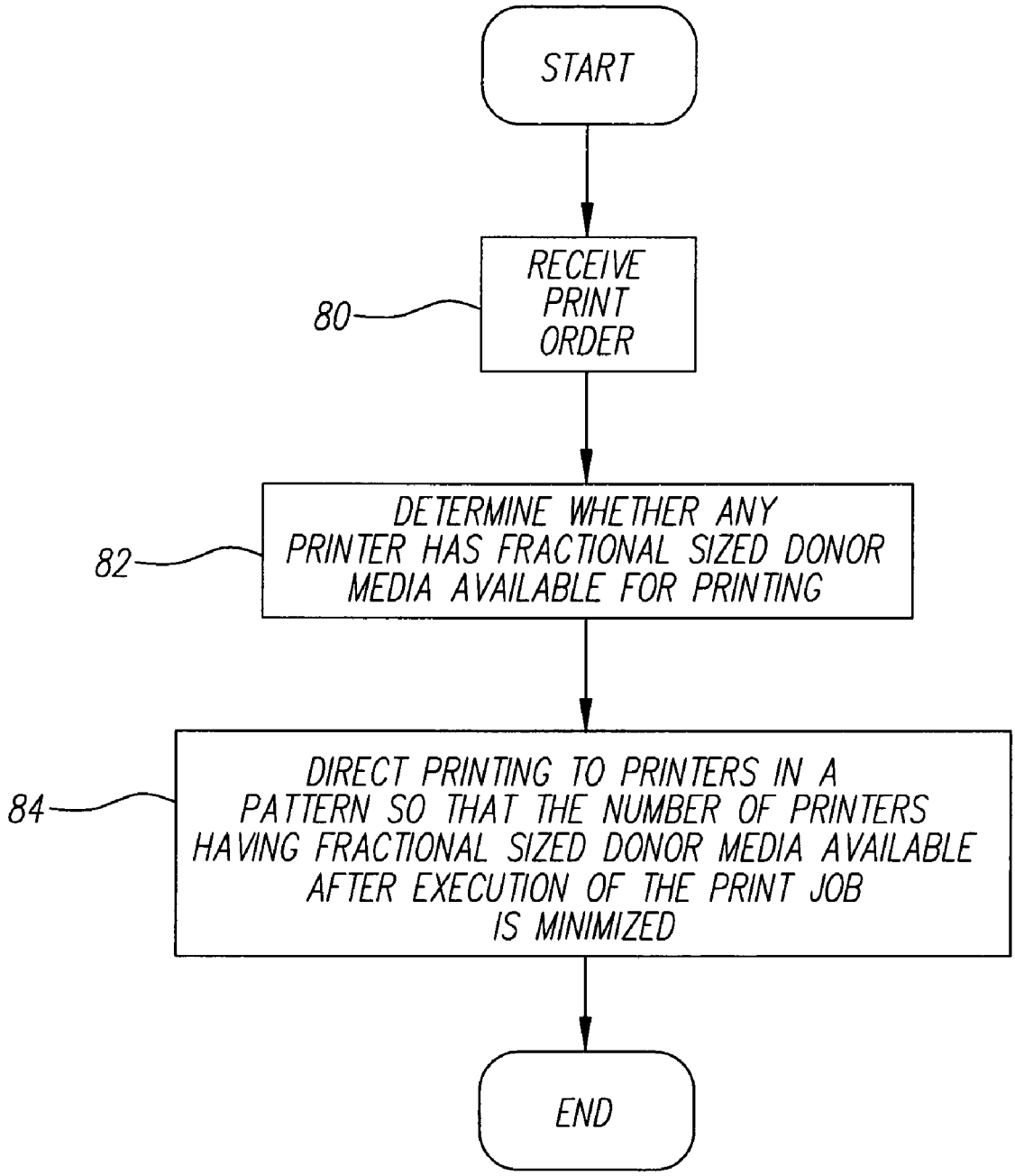
FIG. 4 shows a flow diagram of a method for operating a printing system in accordance with the invention.

FIG. 4 provides a flow diagram showing one embodiment of a method for operating a printing system 18 in accordance with the invention. As is shown in the embodiment of FIG. 4 an initial print order is received by the printer (step 80). The print order contains instructions sufficient for printing system controller 20 to initiate printing operations. Printing system controller 20 can receive a print order in a variety of ways including but not limited to receiving entries made by way of user input system 62, signals received at a communication system 74 or in response to a data provided by way of memory 68 including but not limited to data provided by way of a removable memory (not shown).

Each print order generally provides sufficient information from which printing system controller 20 can determine what image is to be printed and the quantity of images to be printed. Typically, the order will provide image data for the image to be printed, however, the order can simply designate a location at which printer controller 20 can obtain the image data. As is shown in the embodiment of FIG. 4, printing system controller 20 determines whether any printer has a fractional donor patch set available on the donor ribbon therein from a previous fractional sized print (step 82). This can be done in a variety of ways. In one embodiment, this is done by causing printing system controller 20 to store data, for example in memory 68 that can be used for this purpose, such as may occur by maintaining a log of all print orders executed using the first donor ribbon 30 and the second donor ribbon 50. In another embodiment, printing system controller 20 can transmit a printer status command to each of first printer 22 and second printer 42 causing each of the first printer controller 23 and second printer controller 43 to respond with a data signal indicating whether first printer 22 and second printer 42 have a fractional donor patch set available for printing purposes.

Printing system controller 20 is adapted to direct portions of the print job to the printers in a pattern that minimizes the number of printers having a fractional donor patch set available after the printing order has been executed (step 84). This can be done, for example, by using the information from the printing order to determine whether performing the print job will require a printer to print a fractional sized image and directing any printing need for a fractional sized image to a printer that is determined to have a donor media supply with a fractional donor patch set available for printing so that the donor material in the available fractional donor patch set is consumed in rendering the requested output.

Figure 5:
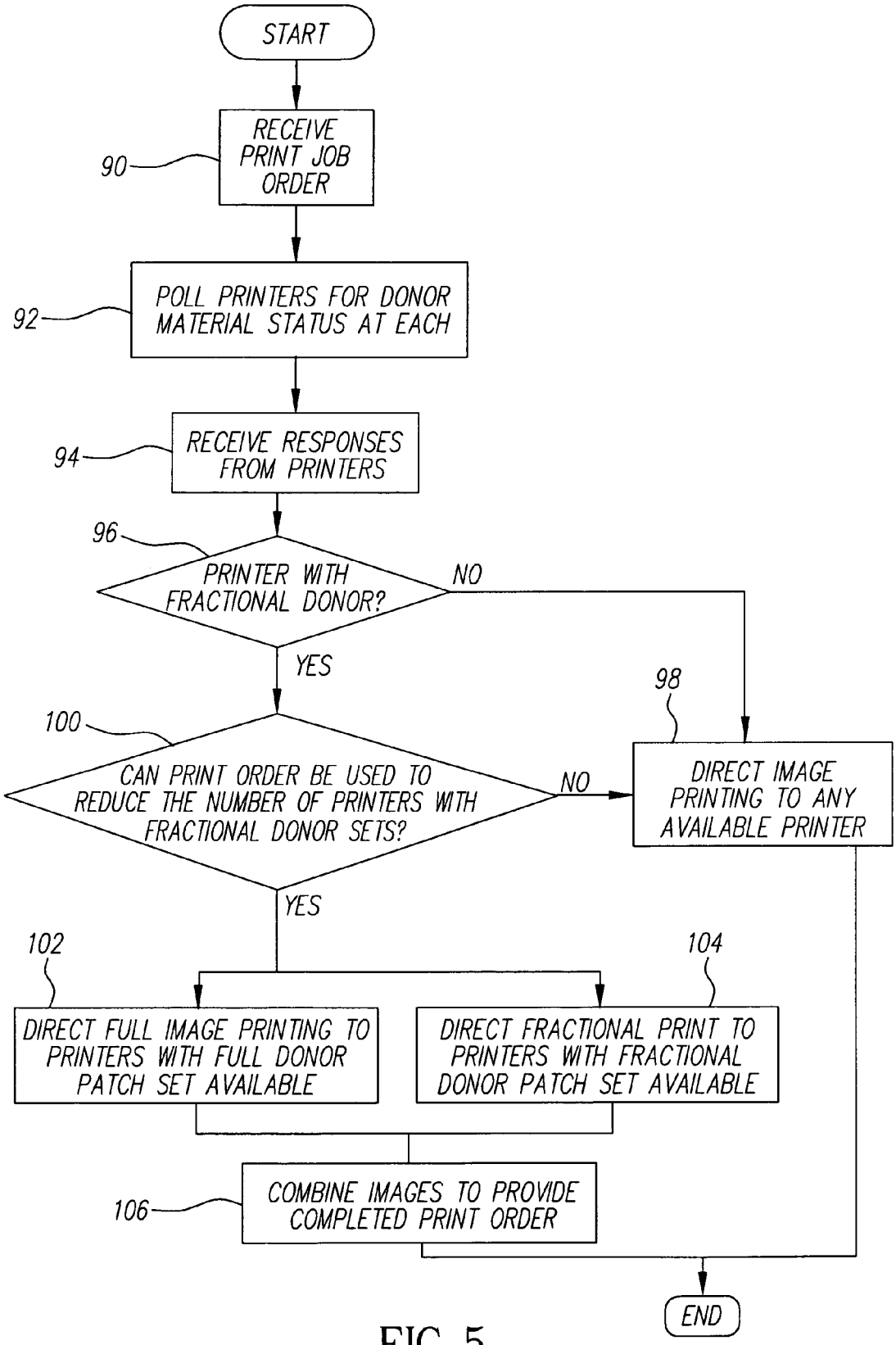
FIG. 5 shows a flow diagram of a method for operating a printing system in accordance with the invention.
Figure 6:
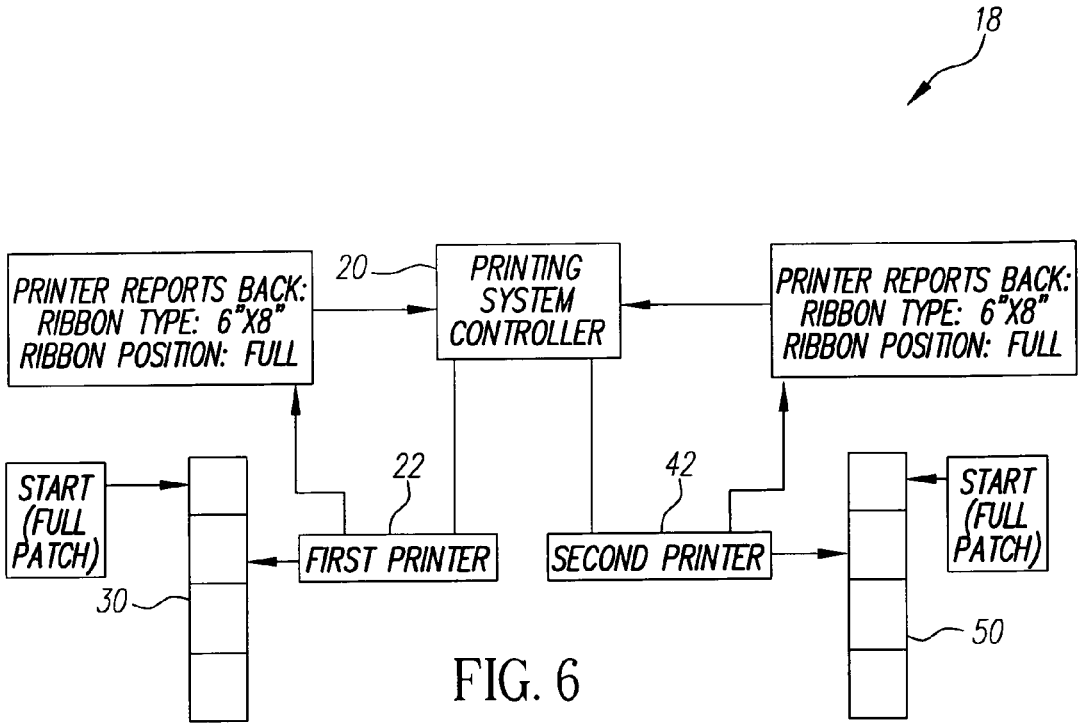
FIG. 6 illustrates the operation of one embodiment of a method for operation a printing system of the invention as applied at a time of starting up the printing system.

FIG. 5 provides a flow chart depicting another embodiment of a method for operating a printing system. FIGS. 6–11 illustrate the operation of this method using the embodiment of printing system 18 illustrated in FIG. 1. In the embodiment of FIG. 5, a print order is received (step 90) and the printing system controller 20 transmits a donor ribbon status-polling signal to first printer 22 and second printer 42 (step 92). As is illustrated in FIG. 6, first printer controller 23 responds to the donor status ribbon polling signal by transmitting a report indicating whether a fractional donor patch set is available for printing by first printer 22, and second printer controller 43 response to the donor status ribbon polling signal by transmitting a report indicating whether a fractional donor patch set is available for printing by second printer 42.

For the purposes of FIGS. 6–11 it will be assumed that first printer 22 and second printer 42 are adapted to print images either at a full-size or at a half size. However, this is done simply for convenience, and it will be appreciated that in other embodiments of the invention, fractional sized printing can involve other fractional sizes such as quarter size, wallet size, or the like.

As illustrated in FIG. 6, when printing system 18 is at an initial start-up point, first printer controller 23 responds to the donor ribbon status polling signal by the reporting that first printer 22 has a first donor ribbon 30 therein that has a donor patch set available for full size printing and that first donor ribbon 30 loaded therein is of a 6"×8" type. Similarly, second printer controller 43 responds to the donor ribbon status polling signal by reporting that the second printer 42 has a second donor ribbon 50 therein with a donor patch set available for print full size printing and that second donor ribbon 50 is of a 6"×8" type.

Returning now to FIG. 5, printing system controller 20 receives the reports from the first printer controller 23 and second printer controller 43 (step 94) and determines therefrom whether any printer has a fractional donor patch set available for printing (step 96). Because first printer controller 23 and second printer controller 43 have reported that they do not have fractional donor patch set the available for printing, printing system controller 20 can direct a first print order of any type to either or both of first printer 22 and/or second printer 42 (step 98).

Figure 7:
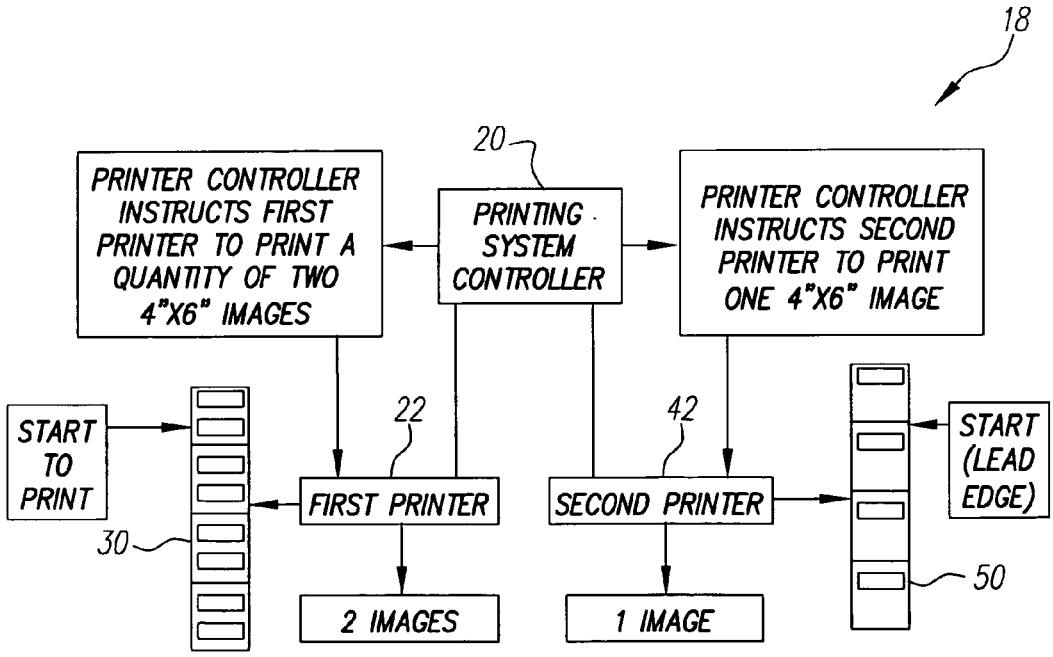
FIG. 7 illustrates the operation of one embodiment of the method of the invention used to print three images.

FIG. 7 illustrates one example of the way in which printing system controller 20 can direct printing work to first printer 22 and second printer 42 in order to complete a first print job requesting three printed images. In the embodiment of FIG. 7, printing system controller 20 uses both of first printer 22 and second printer 42 to complete the print job. This can be done, for example, in order to decrease the time required to render the print order by causing portions of the print order to be printed simultaneously. As illustrated in FIG. 7, printing system controller 20 does this by transmitting a printing instruction to first printer 22 instructing printing system 18 to print two 4" by 6" images using substantially all of the donor material available in the first donor patches 32 of first donor ribbon 30 and by instructing second printer 42 to print one 4"×6" image.

As is shown in FIG. 7, at the completion of the first print job, each donor patch of the first donor patch set 32 of first donor ribbon 30 has been exhausted in rendering the two 4" by 6" images. Accordingly, at the conclusion of the first printing operation, first printer 22 will advance first donor ribbon 30 from first donor patch set 32 to a subsequent unused donor set and will store information indicating that first printer 22 the has a donor ribbon 30 that is available to print a full 6"×8" image. Conversely, at the conclusion of the first printing operation, second printer 42 will determine that sufficient donor media remains on second donor patch set 52 to allow for a fractional image to be printed. Accordingly, second printer controller 43 will store ribbon status information indicating that second printer 42 has a second donor ribbon 50 therein having a second donor patch set 52 that is available for fractional image printing.

Figure 8:
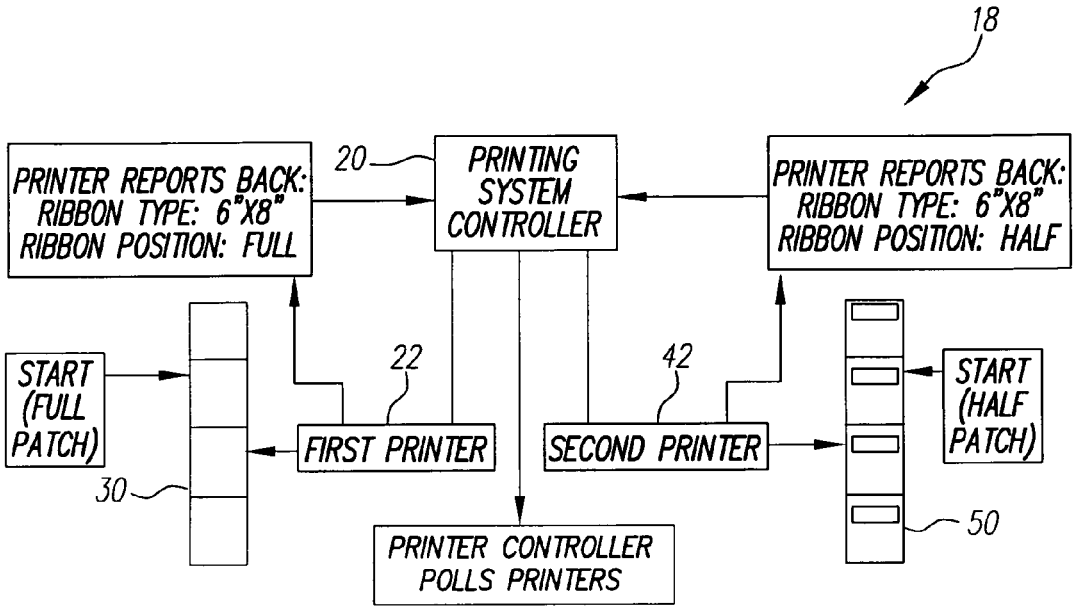
FIGS. 8 and 9 illustrate the operation of one embodiment of the method of the invention used to print four images.

When as shown in FIG. 8, a second print order is received by printing system controller 20 (step 90), printing system controller 20 again transmits a donor ribbon status polling signal to first printer controller 23 and second printer controller 43 (step 92). First printer controller 23 responds to the donor ribbon status polling signal by the reporting that first printer 22 has a first donor ribbon 30 therein with a donor patch set that is available to print a full sized image and first donor ribbon 30 loaded therein is of a 6"×8" type. However, second printer controller 43 responds to the donor ribbon status polling signal by reporting that the second printer 42 has a second donor ribbon 50 therein with a donor patch set that is available to print fractional sized images and that second donor ribbon 50 is of a 6"×8" type.

Figure 9:
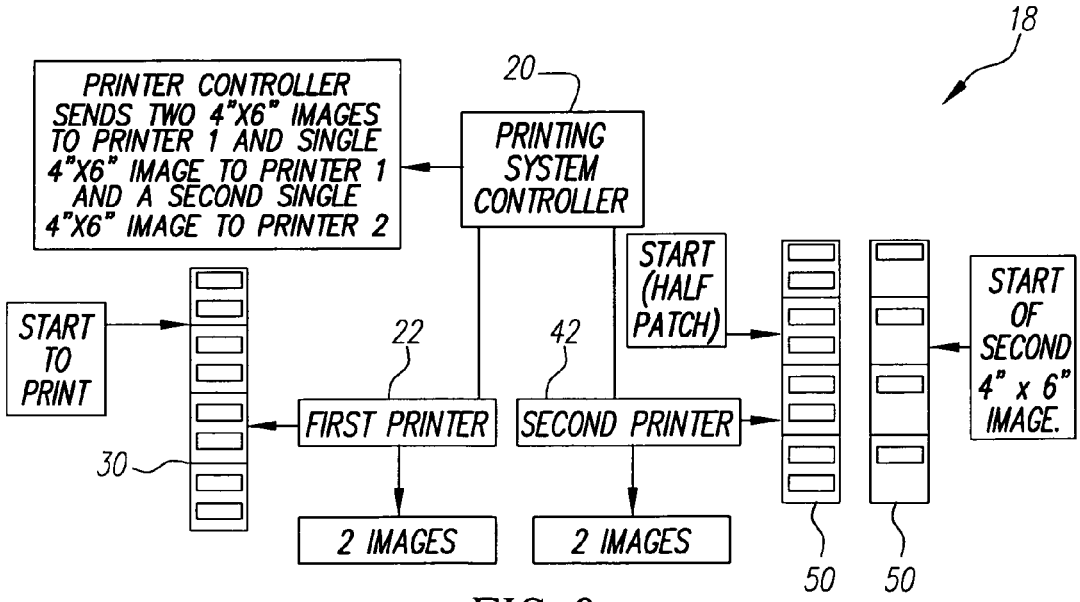

Returning now to FIG. 5, printing system controller 20 receives the reports from first printer controller 23 and second printer controller 43 (step 94) and determines therefrom that second printer 42 has a donor patch set available for printing at a fractional size (step 96). Printing system controller 20 then determines whether the fractional donor patch set can be used in the satisfaction of the print order so that at the completion of the print order, the number of printers having available fractional donor patch sets is minimized (step 98). Under the circumstances depicted in FIG. 8, this is not possible because the second print order requires printing of four 4"×6" images which will consume two full donor sets. Accordingly, in the embodiment of FIG. 8, printing system controller 20 can direct either of first printer 22 or second printer 42 to print all four of the images of the print job or, where timeliness is of the essence, each printer can be directed to print two the of the images for the print job as is illustrated in FIG. 9.

It will be appreciated that using either approach leaves the printing system 18 in the same overall state at the conclusion of the second printing job that the printing system 18 was in at the beginning of the second printing order in that first printer 22 completes the second print job with first donor ribbon 30 having a donor patch set available for printing a full sized image and second printer 42 has second donor ribbon 50 therein with a fractional donor patch set available for printing. Printing system controller 20 can also use other patterns of distribution so long as the number of printers having donor patch sets available for fractional printing is reduced.

Figure 10:
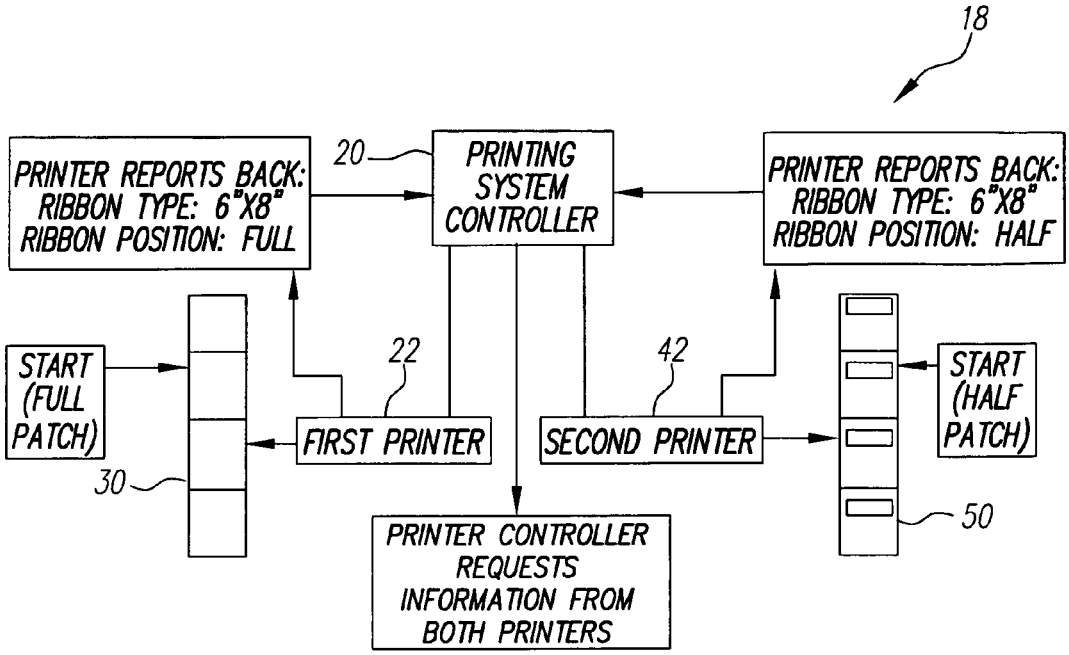
FIGS. 10 and 11 illustrate the operation of one embodiment of the invention used to print five images.

When as shown in FIG. 10, a third print order is received by printing system controller 20 (step 90), printing system controller 20 again transmits a donor ribbon status polling signal to first printer controller 23 and second printer controller 43 (step 92). First printer controller 23 responds to the donor ribbon status polling signal by reporting that first printer 22 has a first donor ribbon 30 therein having a donor patch set that is available to print a full sized image and that first donor ribbon 30 loaded therein is of a 6"×8" type. However, second printer 42 responds to the donor ribbon status polling signal by reporting that the second printer 42 has a second donor ribbon 50 therein having a donor patch set that is available to print fractional sized images and that second donor ribbon 50 is of a 6"×8" type.

Returning now to FIG. 5, printing system controller 20 receives the reports from first printer 22 and second printer 42 (step 94) and determines therefrom that second printer 42 has a donor patch set available for printing at a fractional size (step 96). Printing system controller 20 then determines whether the fractional donor patch set can be used in the satisfaction of the print order so that at the completion of the print order, the number of printers having fractional donor patch sets is reduced (step 100). Under the circumstances depicted in FIG. 10, this is possible because the third print order requires printing of five 4"×6" images which will consume two full donor patch sets and one fractional half-patch set.

Figure 11:
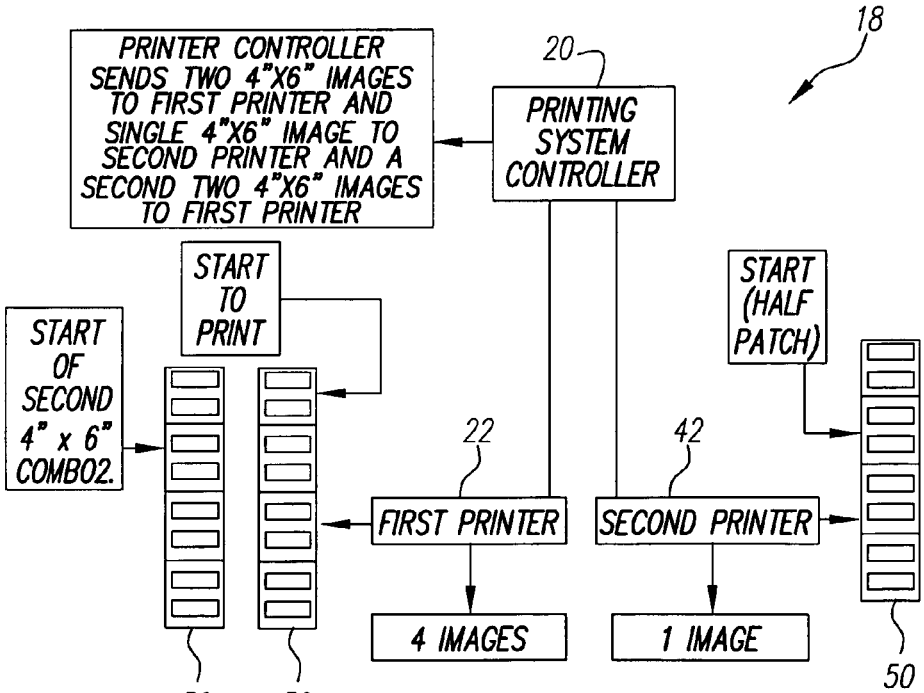

Accordingly, as shown in FIG. 10, printing system controller 20 can direct either of first printer 22 or second printer 42 to print four images of the print job in the form of two pairs of images with each pair being printed using a fill donor patch set. However, the one remaining 4"×6" fractional image of the five 4"×6" images will be routed to second printer 42 because second printer 42 has a fractional donor patch set available (step 104). As illustrated in FIG. 11, this causes both first printer 22 and second printer 42 to complete the third print job in a condition where the first donor ribbon 30 and second donor ribbon 50 are be advanced so that each printer is available for full image printing. The images printed by different printer are then combined for delivery to a client (step 106).

It will be appreciated that using this approach, a printing system controller 20 is provided that is adapted to direct printing orders to thermal printers so that the number of thermal printers that have fractional donor patch sets available for printing at the start of a subsequent printing job is minimized.

In one additional embodiment of the invention, printing system controller 20 can also request information from first printer 22 and second printer 42 identifying characteristics such as the type and size of donor material that remains in a donor patch set so that more refined determinations of the nature of the fractional donor patch set that remains can be made and so that this information can be used in determining whether a fractional donor patch set is appropriate for use in a particular print job.

The invention has been described in detail with particular reference to certain preferred embodiments thereof, but it will be understood that variations and modifications can be effected within the spirit and scope of the invention.

Parts List

18 printing system
20 printer controller
22 first printer
23 first printer controller
24 first thermal print head
25 first receiver medium cutter
26 first receiver medium
30 first donor ribbon
32 first donor patch set
34 yellow donor patch
36 magenta donor patch
38 cyan donor patch
40 clear overcoat patch
42 second printer
43 second printer controller
44 second thermal print head
45 second thermal medium cutter
46 second receiver medium
50 second donor ribbon
52 second donor patch set
54 yellow donor patch
56 magenta donor patch
58 cyan donor patch
60 clear overcoat patch
62 user input system
64 output system
66 sensors
68 memory
70 removable memory interface
72 hard drive
74 communication system
76 remote memory system
80 receive print order step
82 determine available fractional sized print step
84 directing step
90 receive print order step
92 send polling signal step
94 receive report step
96 determining step
98 print at any printer step
100 determining step
102 print non-fractional images at any printer step
104 direct fractional images at printer with patch set with fractional donor step
106 combine images printed by different printers step

The invention claimed is:

1. A method for operating more than one thermal printer adapted to print images by transferring donor material from patches of donor material from a donor ribbon onto a receiver medium, each printer being operable to print images in a manner that exhausts a full donor patch or a fractional donor patch during printing, the method comprising the steps of:

receiving a print order;

determining whether a fractional donor patch set is available for printing at each printer; and directing portions of the print order to the printers in a pattern that minimizes the number of printers having donor ribbon with a fractional donor patch set available after the printing job has been executed.

2. The method of claim 1, wherein the step of determining whether a fractional donor patch set is available for printing comprises polling each of the printers to determine a donor ribbon status for each printer and receiving a report back from each printer from which it can be determined whether a fractional donor patch set is available for that printer.

3. The method of claim 1, wherein the step of determining whether a fractional donor patch set is available for printing comprises maintaining data from which it can be determined whether a printer has a fractional donor patch set available at the printer.

4. The method of claim 1, wherein the step of directing portions of the print order to the printers in a pattern that minimizes the number of printers having donor ribbon with a fractional donor patch set after the printing order has been executed comprises determining whether a print order contains instructions that require printing using a fractional donor patch set and directing any such required print to a printer having a fractional donor patch set available.

5. A printing system comprising:

more than one thermal printer with each thermal printer being adapted to print images by transferring donor material from patches of donor material on a donor ribbon to form an image on a receiver medium and with each printer being operable to print images in a manner that exhausts a full donor patch set or in a manner that exhausts a fractional donor patch set during printing; and a controller adapted to receive a print order that determines whether a fractional donor patch set is available for printing at each printer; and to direct portions of the print order to the printers in a pattern that minimizes the number of printers having donor ribbon with a fractional donor patch set available after the printing order has been executed.

6. The printing system of claim 5, wherein the controller is adapted to determine whether a fractional donor patch set is available for printing by polling each of the printers to determine a donor ribbon status for each printer and receiving a report back from each printer from which it can be determined whether a fractional donor patch set is available for that printer.

7. The printing system of claim 5, wherein the controller is adapted to determine whether a fractional donor patch set is available for printing by maintaining data from which it can be determined whether a printer has a fractional donor patch set available at the printer.

8. The printing system of claim 5, wherein the controller is adapted to direct portions of the print order to the printers in a pattern that minimizes the number of printers having donor ribbon with a fractional donor patch set available after the printing order has been executed comprises determining whether a print order contains instructions that require printing using a fractional donor patch set and directing any required printing to a printer having a fractional donor patch set available.

9. A control system for operating more than one thermal printer adapted to print images by transferring donor material from patches of donor material from a donor ribbon onto a receiver medium, each printer being operable to print images in a manner that exhausts a full donor patch or a fractional donor patch set during printing, comprising:

a means for receiving a print order;

means for determining whether a fractional donor patch set is available for printing at each printer; and and a directing means for directing portions of the print order to the printers in a pattern that minimizes the number of printers having donor ribbon with a fractional donor patch set after the printing order has been executed.

10. The control system of claim 9, further comprising a means for determining characteristics of the fractional donor patch set and wherein the directing means directs portions of the print order further based upon the determined characteristics.

* * * * *